United States Patent [19]

Brink et al.

[11] Patent Number: 4,706,903

[45] Date of Patent: Nov. 17, 1987

[54] APPARATUS FOR THE HYDROLYSIS AND DISINTEGRATION OF LIGNOCELLULOSIC

[75] Inventors: David L. Brink, Berkeley; Michael M. Merriman, San Pablo, both of Calif.; David A. Mixon, Warren, N.J.

[73] Assignee: The Regents of the University of California, Berkeley, Calif.

[21] Appl. No.: 653,065

[22] Filed: Sep. 21, 1984

[51] Int. Cl.[4] ..... B02C 13/18; C13K 1/00; C13K 1/02

[52] U.S. Cl. ..... 241/188 R; 127/1; 162/261; 241/282.1

[58] Field of Search ..... 127/4, 37, 2, 1; 162/261; 234, 243, 235; 241/188 R, 282.1, 74, 195, 186 R, 189 R

[56] References Cited

U.S. PATENT DOCUMENTS

| | | | |
|---|---|---|---|
| 2,102,961 | 12/1937 | Lewis | 241/89.3 |
| 2,344,611 | 3/1944 | Harris | 241/188 R |
| 2,781,563 | 2/1957 | Horth | 241/186 R |
| 3,123,312 | 3/1964 | Palyi | 241/188 R |
| 3,622,088 | 6/1969 | Gunkel | 241/74 |
| 3,640,476 | 2/1972 | Engels | 241/74 |
| 4,101,080 | 7/1978 | Schmidt | 241/74 |
| 4,384,897 | 5/1983 | Brink | 127/37 |
| 4,407,458 | 10/1983 | Hutinsky | 241/282.1 |

*Primary Examiner*—Steve Alvo

*Attorney, Agent, or Firm*—Edward B. Gregg

[57] ABSTRACT

Apparatus for disintegrating solids resulting from partial hydrolysis of cellulosic or lignocellulosic material comprising a cylindrical chamber having a perforated mid portion and a plurality of hammer elements supported for rotation within and coaxially to the chamber with their tips close to the perforated mid portion of the chamber. This disintegrator may be connected to the lower end of a hydrolyzer to receive the product of hydrolysis from such chamber.

2 Claims, 3 Drawing Figures

APPARATUS FOR THE HYDROLYSIS AND DISINTEGRATION OF LIGNOCELLULOSIC

The invention relates to the treatment of lignocellulosic material.

In Brink and Schaleger U.S. patent application Ser. No. 23,338, filed Mar. 23, 1979, entitled UTILIZATION OF CELLULOSIC AND LIGNOCELLULOSIC MATERIAL, also in Brink U.S. Pat. No. 4,384,897, there is described a process of treating lignocellulosic material in which the lignocellulose, in suitably comminuted form such as wood chips of the type used to make pulp for paper manufacture, is subjected to first stage hydrolysis under relatively mild conditions such that the more easily depolymerizable constituents, namely the hemicelluloses, are depolymerized to monosaccharides without substantially depolymerizing the cellulose. The resulting slurry of solids in a solution of sugars is then put through a disintergrator to reduce the solids to finely divided form. The sugar solution is displaced with a dilute acid solution and the resulting slurry is then subjected to more rigorous hydrolyzing conditions to bring about the depolymerization of the cellulose to glucose. This is a condensed description of the process of the aforesaid pending patent application and issued patent to which reference may be made for further details.

It has been found that this procedure is much more energy efficient than grinding the solid lignocellulosic material to finely divided form before it is introduced into the first hydrolysis stage. Thus assuming that wood chips are the lignocellulosic feed material, they appear to be intact after the first, relatively mild hydrolysis step. That is to say, the chips are not greatly reduced in size although they have had extracted from them the soluble material which is solublized in the first stage of hydrolysis. However these chips are readily reduced to a very fine state, which is favorable to the second hydrolytic step.

It is an object of the present invention to provide an improved disintegrator for this step of disintegration after first stage hydrolysis and before second stage hydrolysis.

Figure 1:
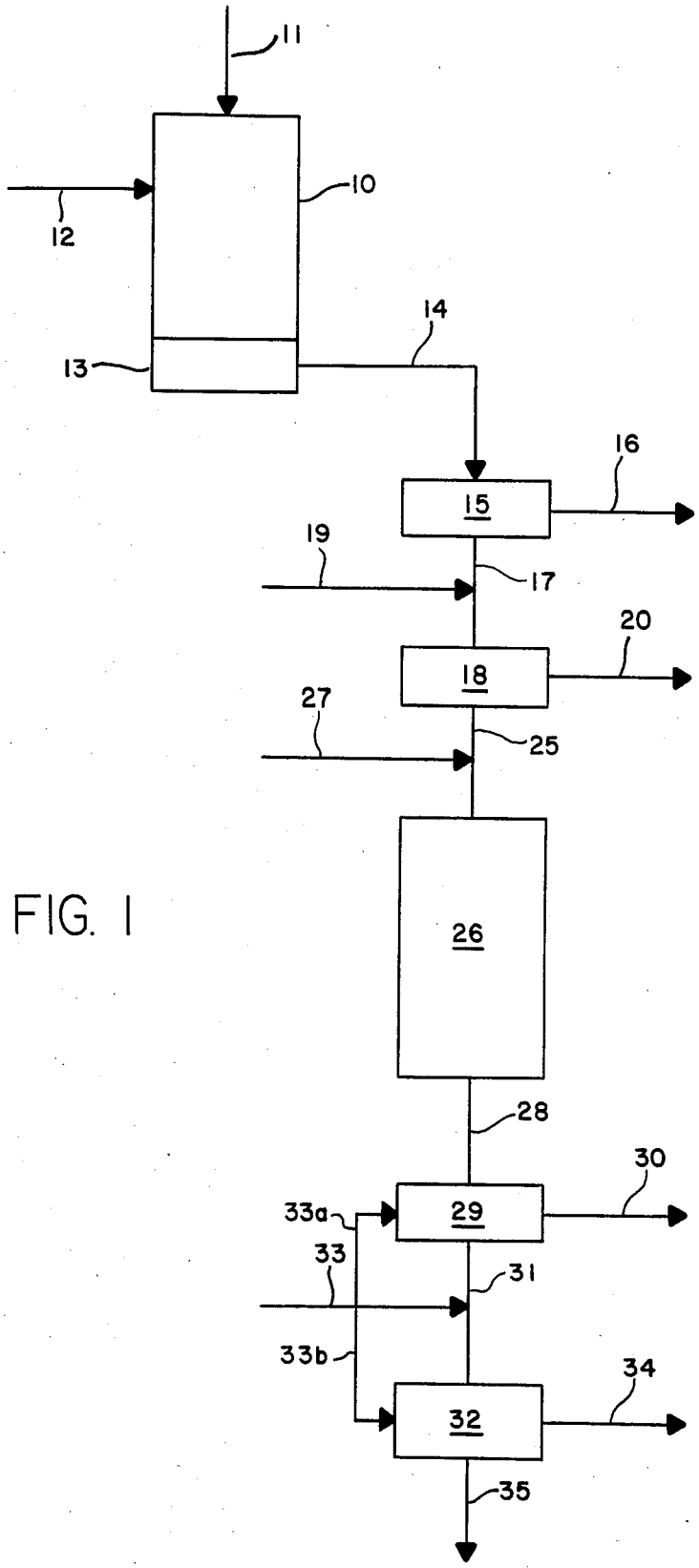
Figure 2:
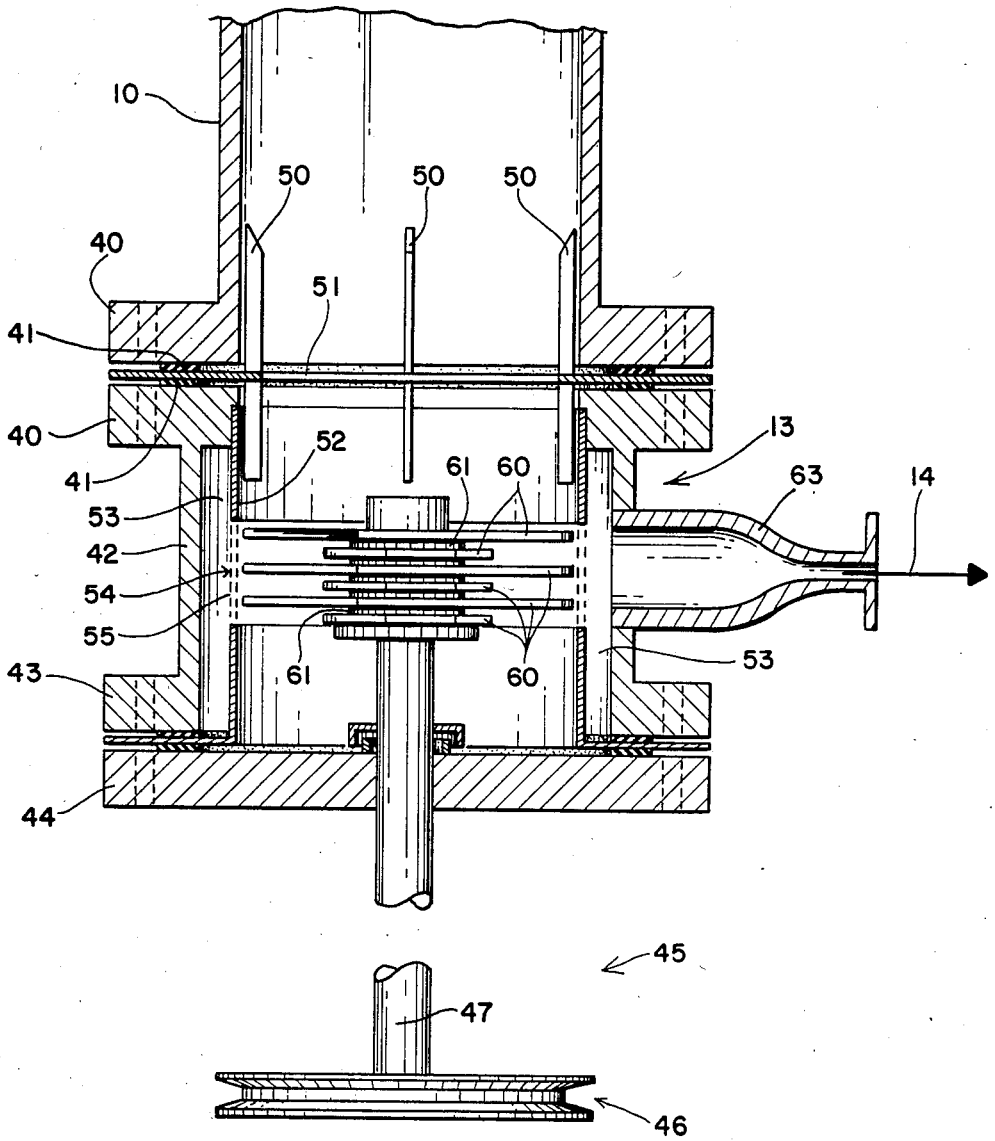
Figure 3:
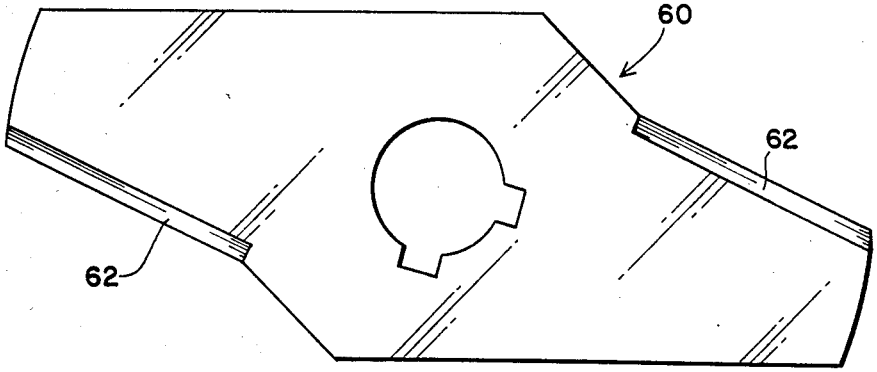

Certain embodiments of the invention are illustrated by way of example in FIGS. 1, 2 and 3 in which FIG. 1 is a diagrammatic representation of the process including the first hydrolytic step, the disintegrating step, separating liquor from the slurry resulting from disintegration, the second hydrolytic step and separating of liquor from the product of the second hydrolytic step;

FIG. 2 is a view in vertical cross-section showing the disintegrator employed to disintegrate the solids resulting from the first hydrolytic step; and FIG. 3 is a top view of one of the hammer elements of the disintegrator.

Referring now to FIG. 1, a first stage hydrolyzer is shown at 10 which is essentially a cylindrical reaction vessel into which wood chips or other lignocellulosic material are introduced at 11 and acid solution at 12. Suitable means (not shown) may be provided such as a rotary feed which supplies chips at a predetermined but controllable rate to hydrolyzer 10. At the lower end of first stage hydrolyzer 10 is the disintegrator 13 of the present invention. Effluent from this disintegrator, which is a slurry of lignocellulosic material and liquor (a solution of monosaccharides) leaves at 14 and enters a separating device 15, which may be a gravity separator, a centrifuge or any other suitable means of separating solids from liquids. Liquor containing sugars is removed at 16. Preferably a continuous flow of material into and through hydrolyzer 10 and disintegrator 13 is maintained at the pressure and temperature in hydrolyzer 10. However, the pressure of the effluent material from disintegrator 13 may be reduced, for example, to atmospheric pressure. This will require reheating for second stage hydrolysis. Solid material (partially hydrolyzed lignocellulose) with some of the liquor is delivered through line 17 to a washing unit 18 to which water is added through line 19. The washing unit 18 may be a centrifuge or other suitable piece of equipment. A further increment of sugar solution is withdrawn through line 20 and the remaining slurry passes through line 25 to second stage hydrolyzer 26. Acid is added through line 27. As explained in the aforesaid patent application and patent hydrolytic conditions in unit 26 are more severe than in unit 10 with the result of hydrolyzing cellulose to glucose. The effluent passes through line 28 into washer-separator 29. Glucose solution is withdrawn through line 30 and a slurry of solids such as lignin leaves through line 31 to washer-separator 32. Water is added through lines 33, **33*a* and 33*b* to line 31 and washer-separators 29 and 32. A further increment of glucose solution leaves through line 34 and a slurry, mat or cake of unhydrolyzed solids which leaves through line 35**.

Instead of carrying out second stage acid hydrolysis in hydrolyzer 26, the solids may be subjected to enzymatic action to depolymerize the cellulose. The finely divided solids resulting from hydrolysis in hydrolyzer 10 and disintegration in disintegrator 13 are amenable to enzymatic treatment.

Referring now to FIG. 2, the lower end of first stage hydrolyzer 10 is shown as is the disintegrator 13. They are joined together by flanges 40 which are bolted together and are provided with suitable gaskets 41. The disintegrator 13 comprises a cylindrical shell 42 joined at the top by means of aforesaid flanges 40 to the lower end of first stage hydrolyzer 10. A bottom flange 43 is bolted to the flange 44 of drive mechanism 45. A pulley is shown at 46 at the bottom of drive shaft 47 as being the driving means for the disintegrator but any other suitable driving means may be employed. The shaft 47 is provided with suitable sealing means (not shown) where it passes through flange 44.

To avoid a vortex which would have the effect of commingling material in the disintegrator 13 with material in hydrolyzer 10, baffles 50 are provided. Baffles 50 are in the form of strips or bars welded or otherwise affixed to and projecting radially inwardly from a baffle ring 51 held between gaskets 41. There are four such baffles of which three are shown and they are spaced apart 90°. These baffles extend radially inwardly. It has been found that this simple baffle system is adequate to ensure that the material passing downwardly through the hydrolyzer 10 enters the disintegrator 13 without forming a vortex and without commingling material in the two portions of the apparatus.

Within the disintegrator 13 and spaced from the shell 42 is an inner lining or cylinder 52, thus providing an annular space 53 between the cylinder 52 and the shell 42. The central portion 54 of cylinder 52 is formed with perforations 55 and is adjacent the hammer zone. The perforations 55 are preferably 0.04 to 0.20 inch in diameter. Affixed to the upper end of the shaft 47 are blades or hammer elements 60 which are spaced axially apart by spacers 61. As will be seen, the tips of the hammer elements are very close to the inner surface of the perforated portion 54 of cylinder 52. In practice a separation of about 0.06 inch is preferred.

Referring now to FIG. 3, one of the hammers 60 is shown as having beveled edges 62. One such hammer is positioned uppermost with the beveled edges facing down and another such hammer is positioned lowermost with its beveled edges facing up. (The intermediate hammer need not have such beveled edges.) This arrangement acts to direct the solid material to the space between the top and bottom hammers.

Referring again to FIG. 2, an outlet is provided at 63 which is connected to line 14 (see FIG. 1).

In operation, a mixture of lignocellulosic material such as wood chips and an acid solution (e.g., a solution of nitric acid at a pH of about 1.2 to 2.0) passes down through first stage hydrolyzer 10 and enters the disintegrator 13 and the shaft 47 rotates the hammer elements at a high speed, for example, 600 rpm. As a result the partially hydrolyzed solid material from which solubles have been extracted is converted to a very fine state of subdivision and passes out through perforations 55 and outlet 63 into the remainder of the process. The particles have a size distribution which is a function of the feed material, the extent of hydrolysis, the speed of the hammers and the size of the perforations 55.

There is thus provided a disintegrator and a process for two stage hydrolysis of lignocellulosic material which disintegrates the partially hydrolyzed and partially solubilized product of a preliminary or first stage, relatively mild hydrolysis. The finely divided solid material, separated from most or all of the liquor, may then be subjected to more severe hydrolysis to depolymerize the cellulose and produce a glucose solution.

We claim:

1. In combination a hydrolyzer for partial hydrolysis of lignocellulosis material and a disintegrator, said hydrolyzer being vertical and having an inlet at its upper end and an outlet at its lower end and having side walls, said disintegrator being vertical, having an open upper end and a closed lower end and having side walls, said disintegrator being arranged in vertical alignment with the lower end of the hydrolyzer and forming therewith a continuous passage to cause continuous, vertical flow of particles of hydrolyzed solids from the hydrolyzer into the disintegrator, the disintegrator comprising a cylinder having between its ends a perforated wall portion, and disintegrating means rotatable within the cylinder about the axis of the cylinder in close proximity to the perforated wall portion of the cylinder, drive means for said disintegrating means and an outlet to receive slurry expelled from the cylinder through the perforated portion thereof, there being also baffle members in the form of bars at the junction of the hydrolyzer and the disintegrator which serve to prevent vortex formation and commingling of material in the disintegrator with material in the hydrolyzer, said bars extending substantially vertically and extending into both the hydrolyzer and the disintegrator and adjacent to the side walls of both the hydrolyzer and the disintegrator.

2. The combination of claim 1 in which the disintegrating means is in the form of a plurality of hammer elements arranged coaxially, the hammer elements at the extremities of the disintegrating means being so shaped as to confine solid material to the space between them.

* * * * *